US009711858B1

(12) United States Patent
Lee et al.

(10) Patent No.: US 9,711,858 B1
(45) Date of Patent: Jul. 18, 2017

(54) IMPEDANCE-CONTROLLED DUAL-FEED ANTENNA

(71) Applicant: AMAZON TECHNOLOGIES, INC., Reno, NV (US)

(72) Inventors: Tzung-I Lee, San Jose, CA (US); In Chul Hyun, San Jose, CA (US); Cheol Su Kim, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 836 days.

(21) Appl. No.: 13/781,279

(22) Filed: Feb. 28, 2013

(51) Int. Cl.
*H01Q 9/00* (2006.01)
*H01Q 9/06* (2006.01)

(52) U.S. Cl.
CPC ..... *H01Q 9/06* (2013.01)

(58) Field of Classification Search
CPC ..... H01Q 1/50
USPC ..... 343/745
See application file for complete search history.

*Primary Examiner* — Graham Smith
(74) *Attorney, Agent, or Firm* — Lowenstein Sandler LLP

(57) ABSTRACT

Antenna structures and methods of operating the same of a dual-feed antenna of an electronic device are described. A dual-feed antenna includes a first antenna element coupled to a controllable circuit that is coupled a first radio frequency (RF) feed, and a second antenna element coupled to a second RF feed. The controllable circuit is configured to electrically connect the first antenna element to the first RF feed in a first antenna configuration and to electrically connect the first antenna element to ground in a second antenna configuration. During the second antenna configuration, the second antenna element is driven by the second RF feed.

23 Claims, 10 Drawing Sheets

IMPEDANCE-CONTROLLED DUAL-FEED ANTENNA

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high-band. One resonant mode in the lower frequency band and one resonant mode in the high-band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
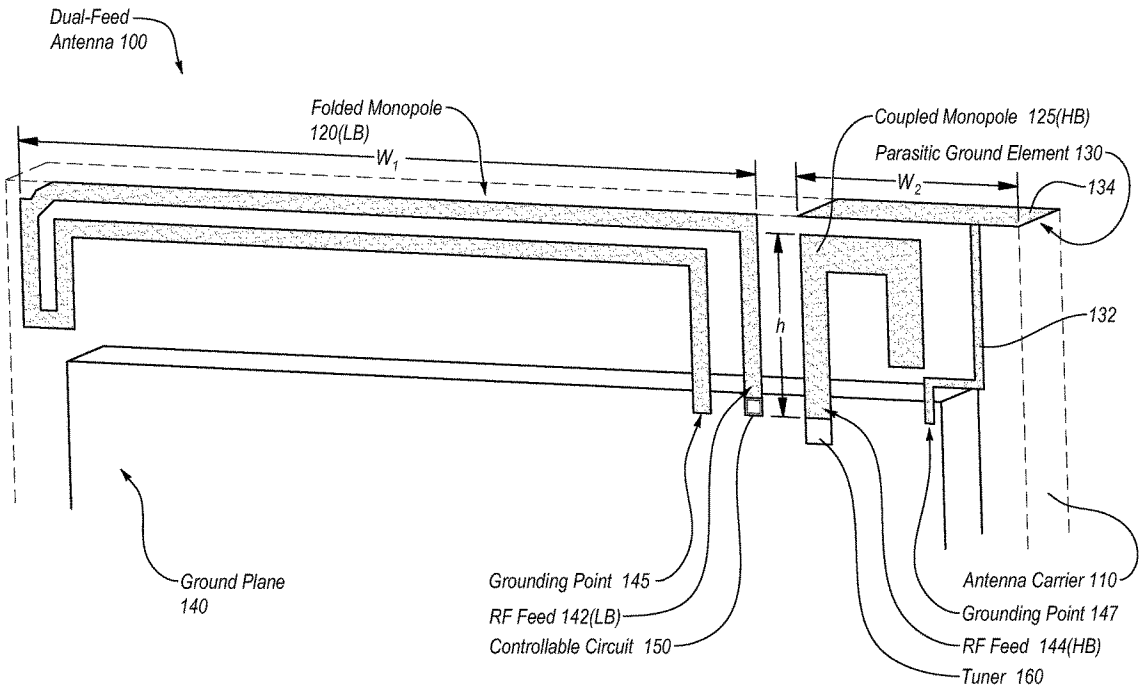
FIG. 1 illustrates one embodiment of a dual-feed antenna including a folded monopole structure coupled to a controllable circuit and a coupled monopole structure.

Antenna structures and methods of operating the same of a dual-feed antenna of an electronic device are described. One dual-feed antenna includes a first RF feed, a controllable circuit coupled to the first RF feed, a second RF feed, and an antenna structure. The antenna structure includes a first antenna element coupled to the controllable circuit, and a second antenna element coupled to the second RF feed. The controllable circuit is configured to electrically connect the first antenna element and the first RF feed in a first antenna configuration and to electrically connect the first antenna element to ground in a second antenna configuration. Another dual-feed antenna includes a first tunable RF feed, a folded monopole structure coupled to the first tunable RF feed. The dual-feed antenna also includes a second RF feed and a coupled monopole structure, a first end of which is coupled to the second RF feed and a second end of which is coupled to a ground plane. The first tunable RF feed is configured to: in a first mode, feed the folded monopole structure to operate in a low band; and, in a second mode, electrically short the first end of the folded monopole structure to the ground plane. The second RF feed is configured to feed the coupled monopole in the second mode to operate in a high band. The folded monopole structure acts as a radiating element for the coupled monopole structure when the first tunable RF is configured in the second mode. The first antenna element in the first mode can be a folded monopole antenna and the first antenna element in the second mode can be a parasitic ground element. In further embodiments, the second antenna element of the dual-feed antenna may further include a parasitic ground element, such as to form a coupled monopole structure for the second antenna structure. When grounded, the first antenna element is a second parasitic ground element.

In a dual-feed antenna, both bandwidth and efficiency in the high-band can be limited by the space availability and coupling between the high-band antenna and the low-band antenna in a compact electronic device. The controllable circuit can be used to improve radiation efficiency by controlling the impedance of the first antenna element. The controllable circuit allows the dual-feed antenna to be an impedance controlled, dual-feed antenna. By controlling the feed impedance of the low-band antenna to short (ground), the controllable circuit converts the low-band radiating element to be part of a high-band radiating structure. Because the low-band antenna element is shorted in the high-band mode, the low-band radiating element does not interfere with the high-band radiating element. The low-band radiating element can act as another parasitic ground element of the high-band radiating element in some designs. In some embodiments, the dual-feed antenna with a low-band radiating element and high-band radiating element, the low-band radiating element can be designed to be resonant at a first fundamental frequency (e.g., about 850 MHz), and the third harmonic of the low-band radiating element falls into a high-band frequency (e.g., about 2.55 GHz). The controllable circuit (e.g., tuner circuit, switch or other circuitry) can be used to change feeding impedance of the low-band radiating element to short and excite the third harmonic of the low-band radiating element at the desired high-band frequency. It should also be noted that the embodiments depicted are folded monopoles, monopoles, coupled monopoles, however, in other embodiments any type of antenna structure can be used, such as, for example, monopole, loop, inverted-F antenna (IFA), slot or the like. In one embodiment, the low-band radiating element operates at about 700 MHz to about 960 MHz in the first mode and the high-band radiating element operates at about 1.7 GHz to about 2.69 GHz in the second mode.

The embodiments described herein are not limited to use in these frequency ranges, but could be used to increase the bandwidth of a multi-band frequency in other frequency ranges, such as for operating in one or more of the following frequency bands Long Term Evolution (LTE) 700, LTE 2700, Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure may be configured to operate in multiple resonant modes, for example, a first high-band mode and a second high-band mode. References to operating in one or more resonant modes indicates that the characteristics of the antenna structure, such as length, position, width, proximity to other elements, ground, or the like, decrease a reflection coefficient at certain frequencies to create the one or more resonant modes as would be appreciated by one of ordinary skill in the art. Also, some of these characteristics can be modified to tune the frequency response at those resonant modes, such as to extend the bandwidth, increase the return loss, decrease the reflection coefficient, or the like. The embodiments described herein also provide a dual-feed antenna with increased bandwidth in a size that is conducive to being used in a user device.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

FIG. 1 illustrates one embodiment of a dual-feed antenna 100 including a folded monopole structure 120 coupled to a controllable circuit 150 and a coupled monopole structure 125. In a first mode, the dual-feed antenna 100 is fed at a first RF feed 142 that is coupled to the folded monopole structure 120. In a second mode, the dual-feed antenna 100 is fed at a second RF feed input 144. During the second mode, the folded monopole structure 120 is grounded by the controllable circuit 150. In the depicted embodiment, a parasitic ground element 130 is disposed in relation to the coupled monopole structure 125. The parasitic ground element 130 is a first parasitic element for the coupled monopole structure 125. The folded monopole structure 120 can also become a parasitic element for the coupled monopole structure 125 in the second mode when grounded, as described herein. A parasitic element is an element of the dual-feed antenna 100 that is not driven directly by the second RF feed 144 (in the second mode). Rather, the second RF feed 144 directly drives another element of the dual-feed antenna 100 (e.g., the coupled monopole structure 125), which parasitically induces a current on the parasitic element. In particular, by directly applying current on the other element by the second RF feed 144, the directly-fed element radiates electromagnetic energy, which induces another current on the parasitic element to also radiate electromagnetic energy. In the depicted embodiment, the parasitic ground element 130 is parasitic because it is physically separated from the coupled monopole structure 125 that is driven at the second RF feed 144, but is laid out so as to form a coupling between the two elements. The driven coupled monopole structure 125 parasitically excites the current flow of the parasitic ground element 130. Similarly, in the second mode, the driven coupled monopole structure 125 may also parasitically excite the current flow on the folded monopole structure 120 that has been grounded, as described herein. In one embodiment, the parasitic ground element 130 and coupled monopole structure 125 can be physically separated by a gap. Alternatively, other antenna configurations may be used to include a driven element and a parasitic element. The dimensions of the coupled monopole structure 125 and the parasitic ground element 130 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another.

In FIG. 1, the ground is represented as a radiation ground plane 140. The ground plane 140 may be a metal frame of the electronic device. The ground plane 140 may be a system ground or one of multiple grounds of the user device. The first RF feed 142 and second RF feed 1422 may be feed line connectors that couple the dual-feed antenna 100 to respective feed lines (also referred to as the transmission lines), which are physical connections that carries the RF signals to and/or from the dual-feed antenna 100. The feed line connectors may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the coupled monopole structure 125 of the dual-feed antenna 100, but is not conductively connected to the parasitic ground element 130 of the dual-feed antenna 100. However, the coupled monopole structure 125 is configured to operate as a feeding structure to the parasitic ground element 130. That is, the coupled monopole structure 125 parasitically induces current on the parasitic ground element 130 as described above. The phrase "conductively connected," as used herein, indicates that the two antenna elements have a connection between them that allows for conduction of current. For example, one element can be physically connected to the other element and this physical connection allows current to flow between the two antenna elements. In other contexts, for purposes of comparison, two elements can be coupled or form a "coupling," without being physically connected. For example, two antenna elements can be disposed in a way to form a capacitive coupling between the two antenna elements or an inductive coupling between the two antenna elements.

In one embodiment, the dual-feed antenna 100 is disposed on an antenna carrier 110, such as a dielectric carrier of the electronic device. The antenna carrier 110 may be any non-conductive material, such as dielectric material, upon which the conductive material of the dual-feed antenna 100 can be disposed without making electrical contact with other metal of the electronic device. In another embodiment, the dual-feed antenna 100 is disposed on, within, or in connection with a circuit board, such as a printed circuit board (PCB). In one embodiment, the ground plane 140 may be a metal chassis of a circuit board. Alternatively, the dual-feed antenna 100 may be disposed on other components of the electronic device or within the electronic device as would be appreciated by one of ordinary skill in the art having the benefit of this disclosure. It should be noted that the dual-feed antenna 100 illustrated in FIG. 1 is a three-dimensional (3D) structure. However, as described herein, the dual-feed antenna 100 may include two-dimensional (2D) structures, as well as other variations than those depicted in FIG. 1.

In the depicted embodiment, the folded monopole structure 120 is coupled to the first RF feed 142, which is coupled to the controllable circuit 150. The folded monopole structure 120 is coupled to the ground plane 140 at a grounding point 145 at a distal end of the folded monopole structure 120. The distal end is the end farthest from the single RF feed 142. In the depicted embodiment, the coupled monopole structure 125 is coupled to the second RF feed 1444, which is coupled to a tuner 160. The tuner 160 can tune the impedance of the coupled monopole 125. The parasitic ground element 130 is coupled to a grounding point 147. In this embodiment, the controllable circuit 150 is configured to electrically connect the folded monopole structure 120 and the first RF feed 142 in a first antenna configuration and to electrically connect the first antenna element to ground in a second antenna configuration. The folded monopole structure 120 can operate as a low-band radiating element in the first antenna configuration and as a high-band radiating element in the second antenna configuration. In a further embodiment, the folded monopole structure 120 can operate as a parasitic ground element in the second antenna configuration. In other embodiments, the first antenna element can be other types of antennas, such as a patch antenna, a planar inverted-F antenna (PIFA) structure, or the like.

In the depicted embodiment, the controllable circuit 150 includes a switch that couples the folded monopole structure 120 to a first matching network coupled to the first RF feed 142 in the first configuration. The switch couples the folded monopole structure 120 to a second matching network coupled to the ground plane 140 in the second configuration. The switch can also couple the folded monopole structure 120 directly to ground without the second matching network.

In one embodiment, the dual-feed antenna 100 is configured to operate in a first frequency range in the first antenna configuration and the dual-feed antenna 100 is configured to operate in a second frequency range in the second antenna configuration. In one embodiment, the first frequency range is about 700 MHz to about 960 MHz and the second frequency range is about 1.71 GHz to about 2.69 GHz. In one embodiment, the folded monopole structure 120 is configured to operate in a first frequency range of about 700 MHz to about 960 MHz in the first antenna configuration and the folded monopole structure 120 is configured to operate in a second frequency range of about 2.5 GHz to about 2.69 GHz in the second antenna configuration. The second frequency range may be covered by a third harmonic of the folded monopole structure 120 as described herein.

In the depicted embodiment, the first antenna element is a folded monopole structure 120 that includes multiple portions: a first portion that extends from the first RF feed 142 in a first direction until a first fold; a second portion that extends from the first fold in a second direction until a second fold; a third portion that extends from the second fold in a third direction until a third fold; a fourth portion that extends from the third fold in a fourth direction until a fourth fold and is laid out at least partially in parallel to the second portion; and a fifth portion that extends from the fourth fold in a fifth direction until the ground plane 140 and is laid out at least partially in parallel to the first portion. In this embodiment, a controllable circuit 150 is disposed at a proximal end of the first portion, the proximal end being the nearest from the first RF feed 142. In the depicted embodiment, the folded monopole structure 120 has a section at a distal end of the folded monopole structure 120 that is folded in the third direction towards the ground plane 140. This can be done to fit the folded monopole structure in a smaller volume while maintaining the overall length of the folded monopole structure 120. It should be noted that a "fold" refers to a bend, a corner or other change in direction of the antenna element. For example, the fold may be where one segment of an antenna element changes direction in the same plane or in a different plane. Typically, folds in antennas can be used to fit the entire length of the antenna within a smaller area or smaller volume of a user device.

In the depicted embodiment, the second antenna element includes the coupled monopole structure 125 and the parasitic ground element 130. In the depicted embodiment, the monopole structure 125 includes various portions: a sixth portion that extends from the second RF feed 144 in the first direction until a fifth fold and is laid out at least partially in parallel to the first portion (of the folded monopole structure 120); a seventh portion that extends from the fifth fold in the fourth direction until a sixth fold; and an eighth portion that extends from the sixth fold in the third direction. A gap is between a distal end of the eighth portion and the ground plane 140, the distal end being the farthest from the second RF feed 144.

In the depicted embodiment, the parasitic ground element 130 is not conductively connected to the second RF feed 144. The parasitic ground element 130 includes a meandering ground line 132 and a block portion 134. The meandering ground line 132 includes a ninth portion that extends from the ground plane 140 in the first direction until a seventh fold; a tenth portion that extends from the seventh fold in the fourth direction until an eighth fold; and an eleventh portion that extends from the eighth fold in the first direction until a ninth fold. The block portion 134 is coupled to a distal end of the ninth portion, the distal end being the farthest away from the ground plane 140 (or farthest from the grounding point 147). The block portion 134 extends in the second direction and fourth direction and is laid out at least partially in parallel to the seventh portion. Although the depicted embodiment illustrates the parasitic ground element 130 as having a meandering ground line 132 and a block portion 134, in other embodiments other structures can be used, such as a monopole, a folded monopole, or other structure based on the available space and overall antenna design.

In this embodiment, the dual-feed antenna 100 is a 3D structure as illustrated in the top perspective view of FIG. 1. The folded monopole structure 120, coupled monopole structure 125 and parasitic ground element 130 are 3D structures that can wrap around different sides of the antenna carrier 110. In particular, in the depicted embodiment, most portions of the folded monopole structure 120 and coupled monopole structure 125 and the meandering ground line 132 are disposed in a first plane (e.g., front surface of the antenna carrier 110). The block portion 134 is disposed in a second plane (e.g., top surface of the antenna carrier 110). Also, as described above, these elements of the dual-feed antenna 100 can be disposed to be coplanar as a 2D structure. Of course, other variations of layout may be used as would be appreciated by one of ordinary skill in the art having the benefit of this disclosure.

The dual-feed antenna 100 may have various dimensions based on the various design factors. In one embodiment, the dual-feed antenna 100 has an overall height (h), an overall width (W), and an overall depth (d). The overall height (h) may vary, but, in one embodiment, is about 10 mm. The overall width (W) may vary, but, in one embodiment, is about 58 mm. The overall depth may vary, but, in one embodiment, is about 4 mm. The folded monopole structure 120 has a width ($W_1$) that may vary, but, in one embodiment, is 40 mm. The coupled monopole structure 125 and parasitic coupled element 130 has a width ($W_2$) that may vary, but, in one embodiment, is 13 mm.

During operation, the controllable circuit 150 is configured to electrically connect the folded monopole structure 120 and the first RF feed 142 in a first antenna configuration and to electrically connect the folded monopole structure 120 to ground in a second antenna configuration. For example, the controllable circuit 150 can configure the folded monopole structure 120 to operate in a first antenna configuration in a first mode and in a second antenna configuration in a second mode. The first antenna configuration can be when the folded monopole structure 120 is configured to operate as a low-band radiating element. The second antenna can be when the folded monopole structure 120 is configured to operate as a part of the second antenna element that operates in the high band. For example, the folded monopole structure 120 can radiate at a third harmonic in the high-band as a high-band radiating element. That is, the same antenna structure can be configured to radiate in the low-band while in the first antenna configuration and to radiate in the high-band while in the second antenna configuration.

In the depicted embodiment, the antenna types of the first and second antennas are different, i.e., a folded monopole antenna and a coupled monopole antenna. In another embodiment, the antenna types may be different combinations of monopole, dipole, patch, slot, or loop antenna structures as would be appreciated by one of ordinary skill in the art. It should also be noted that other shapes for the folded monopole structure 120 are possible. For example, the first antenna element 122 and the second antenna element 124 can have various bends, such as to accommodate placement of other components, such as a speakers, microphones, USB ports. Similarly, other shapes for the coupled monopole structure 125 and parasitic ground element 130 may be used.

Strong resonances are not easily achieved within a compact space within user devices, especially within the spaces on smart phones and tablets. The structure of the dual-feed antenna 100 provides strong resonances at a first frequency range of about 700 MHz to about 960 MHz in the first mode and at a second frequency range of about 1.71 GHz to about 2.69 GHz in the second mode. Strong resonances, as used herein, refer to a significant return loss at those frequency bands, which is better for impedance matching to 50-ohm systems. These multiple strong resonances can provide an improved antenna design as compared to conventional designs.

In this embodiment, the dual-feed antenna 100 includes two antenna elements and one controllable circuit. In other embodiments, more antenna elements and controllable circuits can be used to configure the physical structure of the dual-feed antenna 100. In one embodiment, a second controllable circuit (not illustrated) is coupled to another antenna element coupled to a third RF feed. The second controllable circuit is configured to electrically connect the third antenna element and the third RF feed in the first antenna configuration and to electrically connect the third antenna element to ground in the second antenna configuration.

Figure 2:
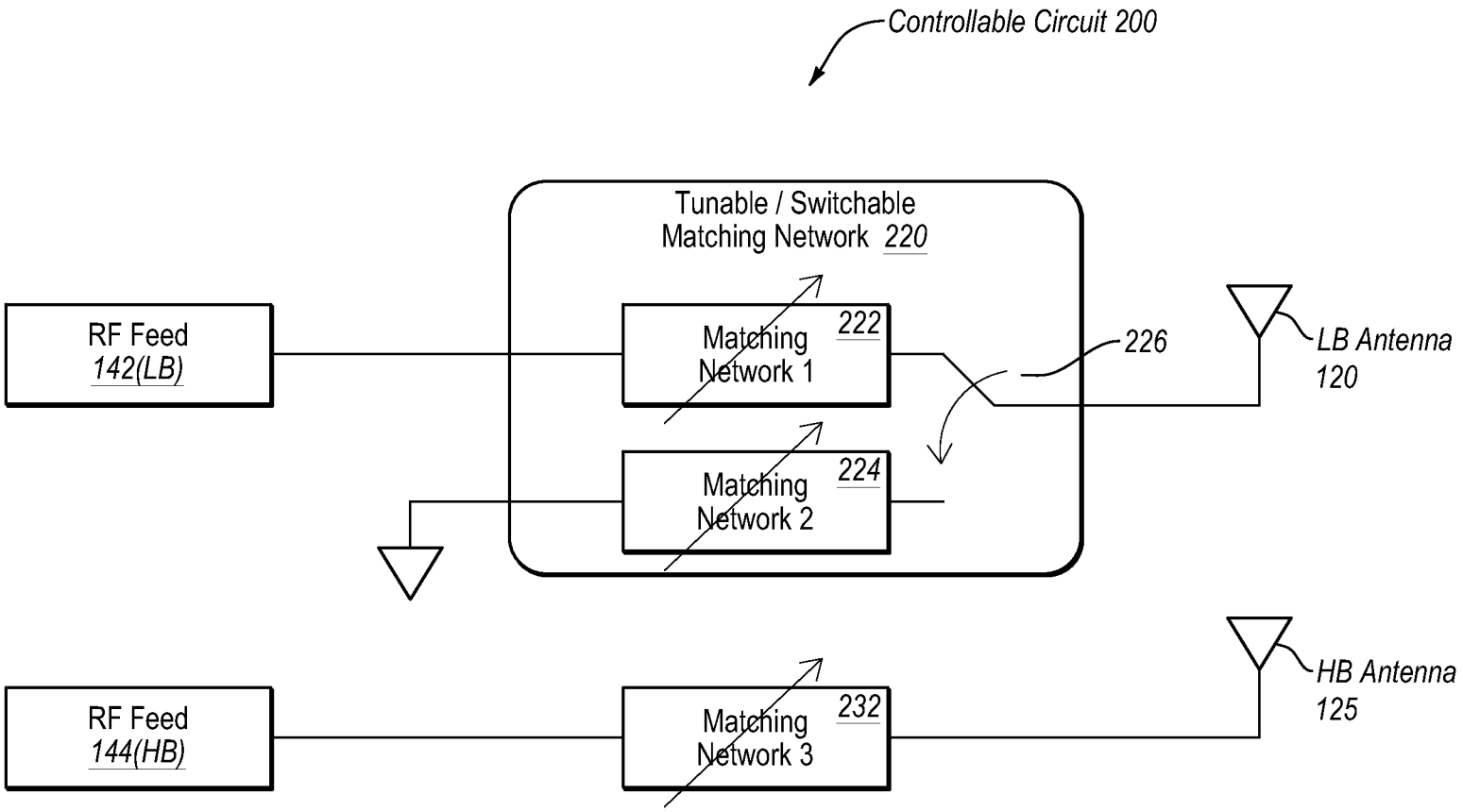
FIG. 2 is a circuit diagram of a controllable circuit according to one embodiment.

FIG. 2 is an equivalent circuit diagram of a controllable circuit 200 according to one embodiment. The controllable circuit 200 includes a tunable matching network 220 coupled to the first RF feed 142 (LB RF feed), ground (e.g., ground plane 140) and the folded monopole structure 120 (LB antenna). In one embodiment, the tunable matching network 220 includes a first matching network 222, a second matching network 224 and a switch 226. The switch 226 is configured to switch the folded monopole structure 120 between the first matching network 222 and the second matching network 224. In effect, the switch 226 is configured to couple the folded monopole structure 120 to the first RF feed 142 in the first antenna configuration and to couple the folded monopole structure 120 to ground in the second antenna configuration. Although not part of the controllable circuit 200, there may be a third matching network 232 (e.g., tuner 160 of FIG. 1) coupled between the second RF feed 144 (HB RF feed) and the coupled monopole structure 125 (HB antenna). The matching networks 222, 224, 232 may include one or more passive components, such as inductors, capacitors, or the like to match impedances for the folded monopole structure 120 and the coupled monopole structure 125.

A processing device, such as described herein, can be used to control the switch 226. For example, the processing device can use a control signal to control the state of the switch 226. Alternatively, other circuits can be used for the controllable circuit to switch between the first RF feed 142 and ground.

Figure 3:
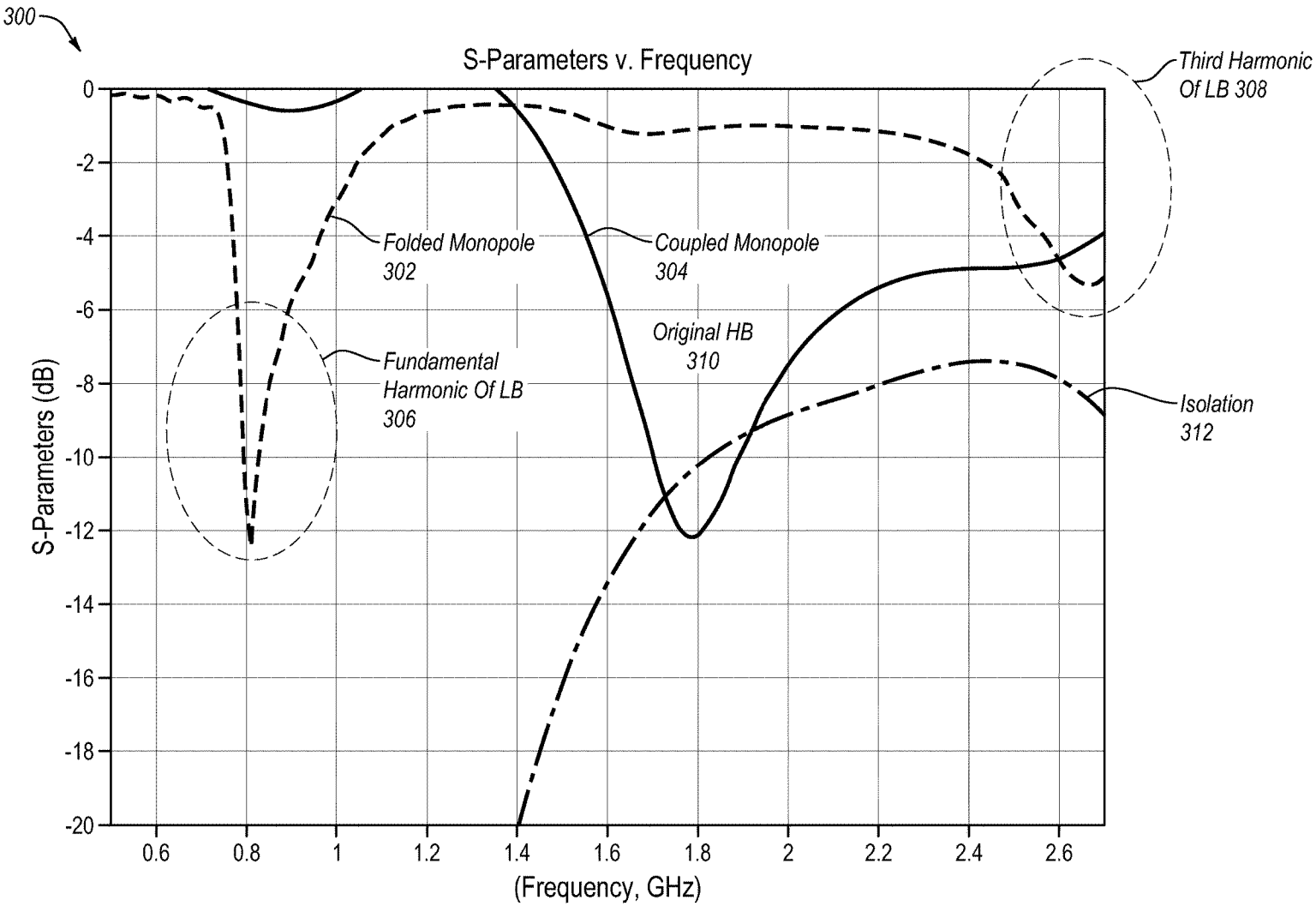
FIG. 3 is a graph of measured reflection coefficients of the two antenna elements of the dual-feed antenna of FIG. 1 according to one embodiment.

FIG. 3 is a graph 300 of measured reflection coefficients 302, 304 of the two antenna elements of the dual-feed antenna of FIG. 1 according to one embodiment. The graph 300 shows the measured reflection coefficient 302 (also referred to S-parameter) of the folded monopole structure 120. The graph 300 shows a fundamental frequency 306 of the low-band radiating element (e.g., folded monopole structure 120 in the first configuration) and a third harmonic 308 of the low-band radiating element (e.g., folded monopole structure 120 in the second configuration). The graph 300 also shows the measured reflection coefficient 304 of the coupled monopole structure 125 (and the parasitic ground element 130). The graph 300 also shows an original high-band 310 of the coupled monopole structure 125. The graph 300 also illustrates isolation 312 between the two antenna elements. In the depicted embodiment, the isolation 312 is between about 1.4 GHz and about 2.69 GHz.

The dual-feed antenna 100 provides a resonant mode of those respective frequencies in the different modes of operation when the controllable circuit 150 configures the dual-feed antenna 100 into the different configurations. That is, the dual-feed antenna 100 decreases the reflection coefficient at the corresponding frequencies to create or form a low band (LB) and a high band (HB). In one embodiment, the dual-feed antenna 100 covers about 700 MHz to about 960 MHz in the LB and about 1.71 GHz to about 2.69 GHz in the HB. The folded monopole structure 120 in the second configuration may contribute to the HB between about 2.5 GHz to about 2.69 GHz due to the third harmonic 308. As described herein, other resonant modes may be achieved. Also, other frequency ranges may be covered by different designs of the dual-feed antenna as would be appreciated by one of ordinary skill in the art having the benefit of this disclosure. The terms "first," "second," "third," "fourth," etc. as used herein are meant as labels to distinguish among different elements and may not necessarily have an ordinal meaning according to their numerical designation.

Figure 4:
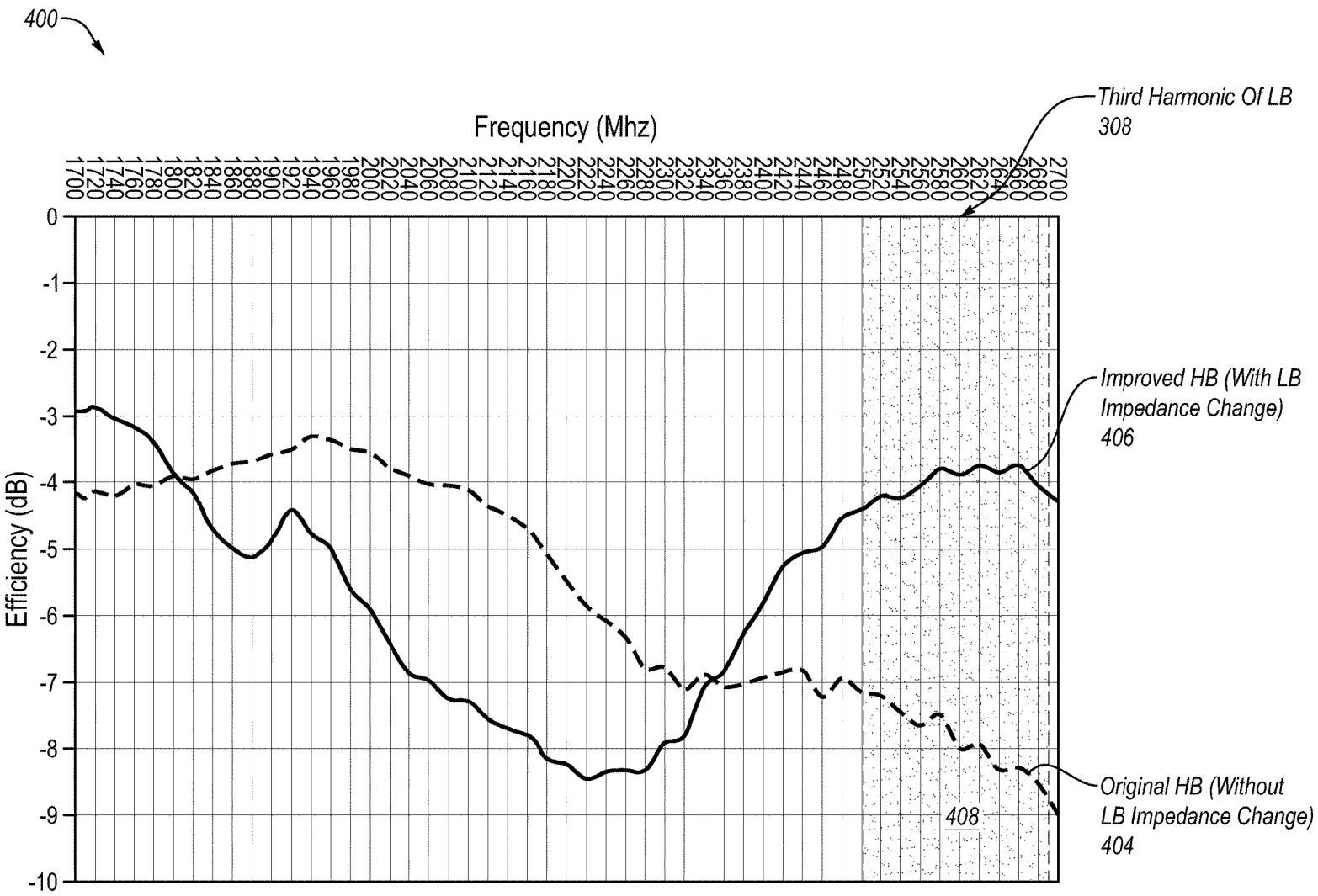
FIG. 4 is a graph of measured efficiencies of the coupled monopole structure of dual-feed antenna 100 of FIG. 1 before and after changing the impedance of the folded monopole structure according to one embodiment.

FIG. 4 is a graph 400 of measured efficiencies 404, 406 of the coupled monopole structure 125 of dual-feed antenna 100 of FIG. 1 before and after changing the impedance of the folded monopole structure 120 according to one embodiment. The graph 400 illustrates the total efficiency 404 (original HB) of the coupled monopole structure 125 over a frequency range of a high-band (HB) of about 1.7 GHz to about 2.7 GHz before changing the impedance of the folded monopole structure 120 (i.e., first configuration). The graph 400 also illustrates the total efficiency 406 (improved HB) of the coupled monopole structure 125 over the frequency range in HB after changing the impedance of the folded monopole structure 120 (i.e., second configuration). As described herein, the third harmonic 308 of the folded monopole structure 120 in the second configuration can increase the antenna's efficiency in the HB. In particular, the third harmonic contributes to the antenna's efficiency in the frequency range of about 2.5 GHz to about 2.7 GHz. The graph 400 illustrates that the dual-feed antenna 100 is a viable antenna for the respective frequency range in the HB and that the antenna efficiency can be improved by grounding the folded monopole structure 120.

As would be appreciated by one of ordinary skill in the art having the benefit of this disclosure the total efficiency of the antenna can be measured by including the loss of the structure (e.g., due to mismatch loss), dielectric loss, and radiation loss. The efficiency of the antenna can be tuned for specified target bands. The efficiency of the dual-feed antenna may be modified by adjusting dimensions of the 3D structure, the gaps between the elements of the antenna structure, or any combination thereof. Similarly, 2D structures can be modified in dimensions and gaps between elements to improve the efficiency in certain frequency bands as would be appreciated by one of ordinary skill in the art having the benefit of this disclosure.

Figure 5:
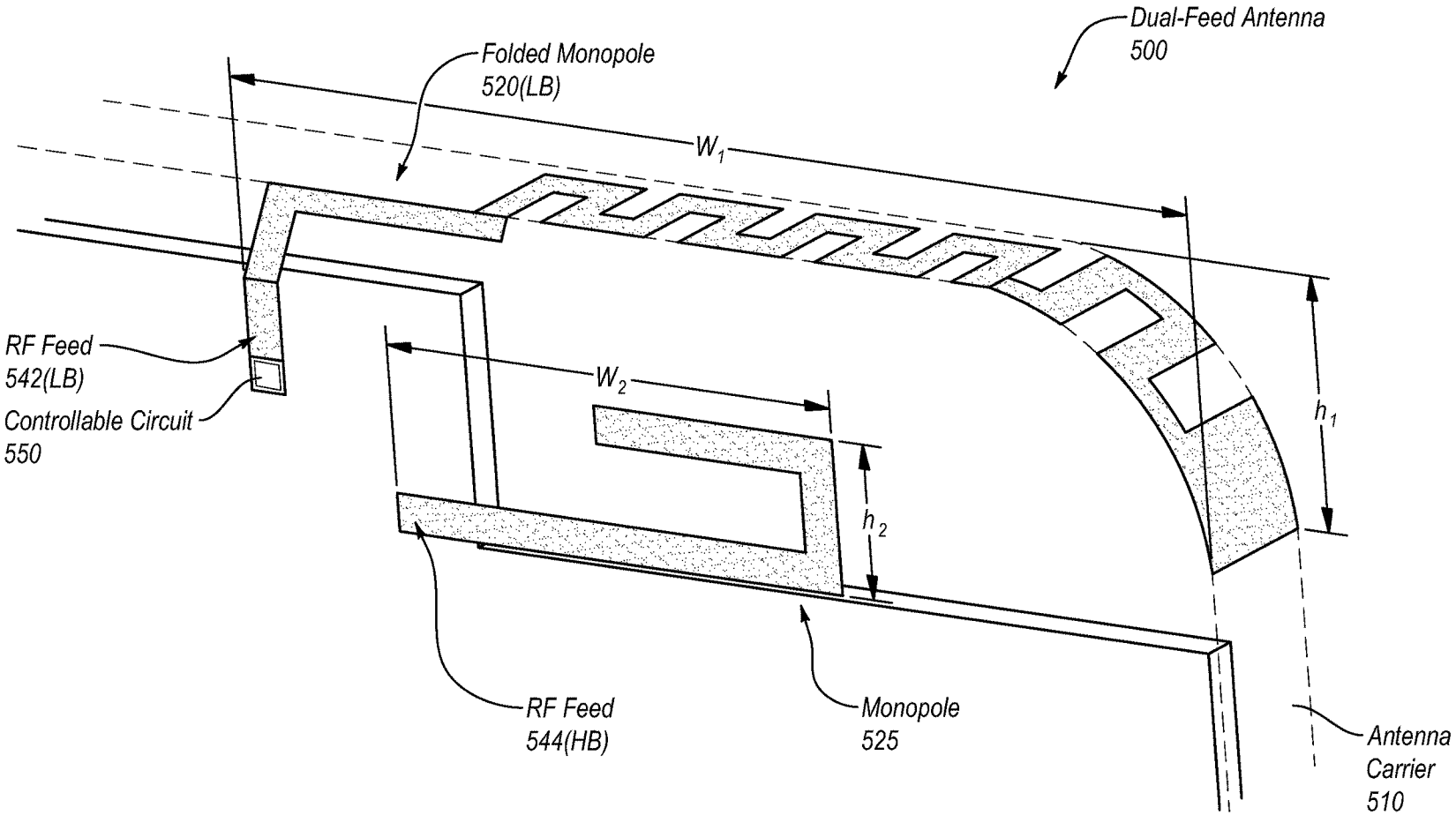
FIG. 5 illustrates another embodiment of a dual-feed antenna including a folded monopole structure coupled to a controllable circuit and a monopole structure.

FIG. 5 illustrates another embodiment of a dual-feed antenna 500 including a folded monopole structure 520 coupled to a controllable circuit 550 and a monopole structure 525. In a first mode (low-band mode), the dual-feed antenna 500 is fed at a first RF feed 542 that is coupled to the folded monopole structure 520. In a second mode (high-band mode), the dual-feed antenna 500 is fed at a second RF feed input 544. During the second mode, the folded monopole structure 520 is grounded by the controllable circuit 550. Like above, the folded monopole structure 520 may be designed as a parasitic ground element for the monopole structure 525 in the second mode when grounded.

In one embodiment, the dual-feed antenna 500 is disposed on an antenna carrier 510, such as a dielectric carrier of the electronic device. The antenna carrier 510 may be similar as the antenna carrier 110 described above.

Figure 6:
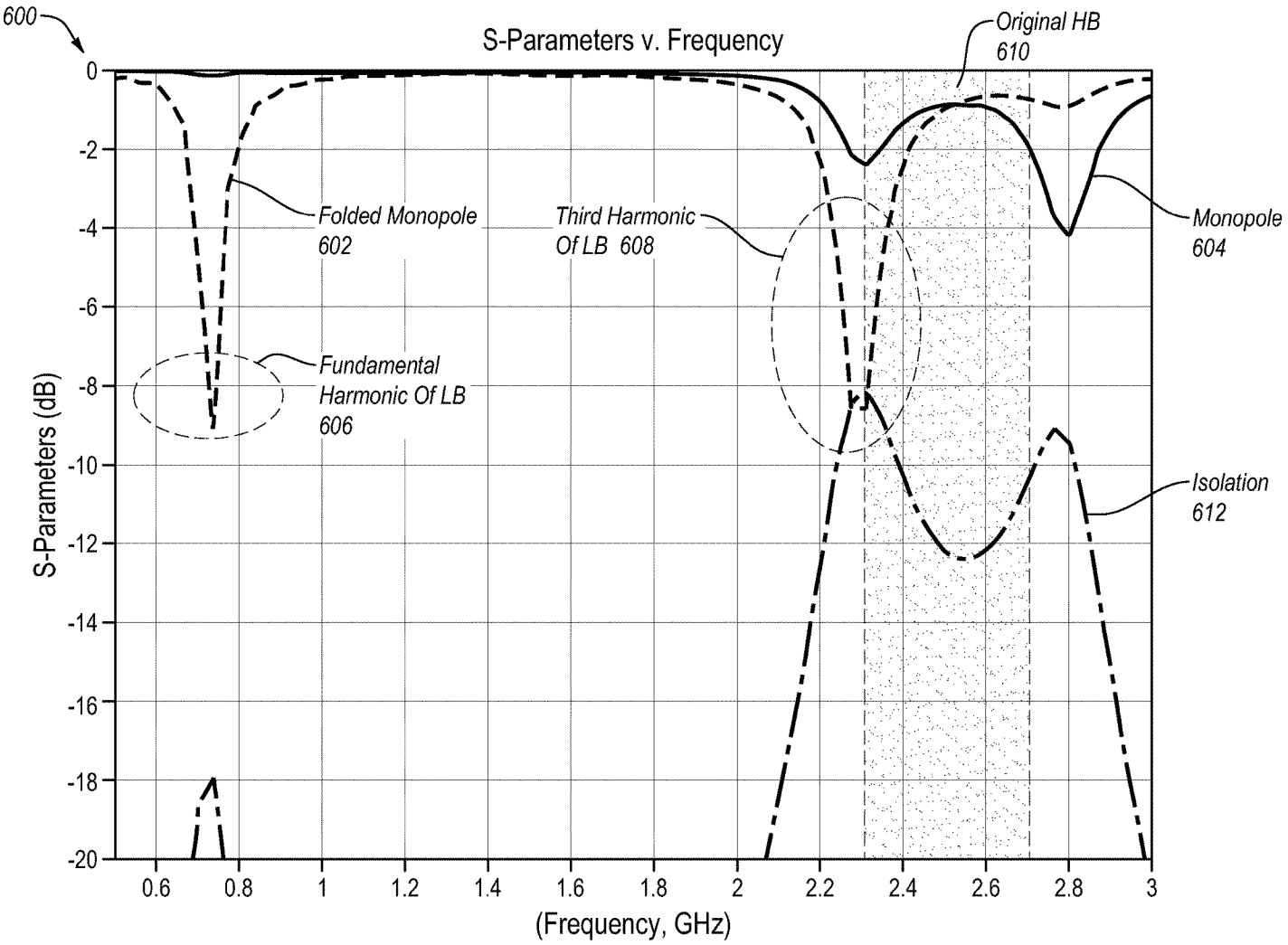
FIG. 6 is a graph of measured reflection coefficients of the two antenna elements of the dual-feed antenna of FIG. 5 in high band before changing the impedance of the folded monopole structure according to one embodiment.

In one embodiment, the dual-feed antenna 500 is configured to operate in a first frequency range in the first antenna configuration and the dual-feed antenna 500 is configured to operate in a second frequency range in the second antenna configuration. In one embodiment, the first frequency range is about 700 MHz to about 960 MHz and the second frequency range is about 2.1 GHz to about 2.99 GHz. As illustrated in FIG. 6, the folded monopole antenna 520 can operate with two resonant modes; a first resonant mode that can be tuned between about 700 MHz and about 1 GHz (fundamental harmonic) and a second resonant mode that can be tuned between about 2.1 GHz to about 2.5 GHz (third harmonic). The monopole antenna structure 522 can operate in two resonant modes in the high-band, such as a first resonant mode centered at about 2.3 GHz and a second resonant mode centered at about 2.8 GHz. In this case, the dual-feed antenna 500 can operate in three resonant modes, and the third harmonic can be used to increase the s-parameter in the high-band in the second antenna configuration. In one embodiment, the folded monopole structure 520 is configured to operate in a first frequency range of about 700 MHz to about 960 MHz in the first antenna configuration and the folded monopole structure 520 is configured to operate in a second frequency range of about 2.1 GHz to about 2.3 GHz in the second antenna configuration. The second frequency range may be covered by a third harmonic of the folded monopole structure 520 as described herein.

In the depicted embodiment, the first antenna element is a folded monopole structure 520 that includes multiple portions: a first portion that extends from the first RF feed 542 in a first direction until a first fold; a second portion that extends from the first fold in a second direction until a second fold; a third portion that extends from the second fold in a third direction until a third fold; a fourth portion that extends generally in the second direction from a distal end of the third portion. The fourth portion may include a set of one or more tessellated fold patterns that reduces a total width of the folded monopole 520, while maintaining an overall length of the antenna element to achieve a desired frequency. In the depicted embodiment, the fourth portion includes about nineteen folds that extend the fourth portion between two depths on a top side of the antenna carrier 510. The depicted embodiment also extends from the top side around a curved edge of the antenna carrier 510 to a side of the antenna carrier 510. This can be done to fit the folded monopole structure 520 in a smaller volume while maintaining the overall length of the folded monopole structure 520. 5

In the depicted embodiment, the second antenna element includes the monopole structure 525. In the depicted embodiment, the monopole structure 525 includes various portions: a fifth portion that extends from the second RF feed 544 in the second direction until a fourth fold; a sixth portion that extends from the fourth fold in the first direction until a fifth fold; and a seventh portion that extends from the fifth fold in a third direction and is laid out at least partially in parallel to the fifth portion. A gap is between a distal end of the seventh portion and the ground plane, the distal end being the farthest from the second RF feed 544.

In this embodiment, the dual-feed antenna 500 is a 3D structure as illustrated in the top perspective view of FIG. 5. The folded monopole structure 520 and monopole structure 525 are 3D structures that can wrap around different sides of the antenna carrier 510. In particular, in the depicted embodiment, portions of the folded monopole structure 520 and the monopole structure 525 are disposed in a first plane (e.g., front surface of the antenna carrier 510), and other portions of the folded monopole structure 520 are disposed in a second plane (e.g., top surface of the antenna carrier 510), and even in a third plane (side of the antenna carrier 510. Also, as described above, these elements of the dual-feed antenna 500 can be disposed to be coplanar as a 2D structure.

The dual-feed antenna 500 may have various dimensions based on the various design factors. In one embodiment, the folded monopole structure 520 has an overall height ($h_1$), an overall width ($W_1$), and an overall depth (d). The overall height ($h_1$) may vary, but, in one embodiment, is about 6 mm. The overall width ($W_1$) may vary, but, in one embodiment, is about 27 mm. The overall depth may vary, but, in one embodiment, is about 4 mm. The monopole structure 525 has a width ($W_2$) that may vary, but, in one embodiment, is 13 mm. The monopole structure 525 has a height ($h_2$) that may vary, but, in one embodiment, is 4 mm. The monopole structure 525 does not have a depth dimension as it is a 2-D structure.

During operation, the controllable circuit 550 is configured to electrically connect the folded monopole structure 520 and the first RF feed 542 in a first antenna configuration and to electrically connect the folded monopole structure 520 to ground in a second antenna configuration. For example, the controllable circuit 550 can configure the folded monopole structure 520 to operate in a first antenna configuration in a first mode (e.g., low-band mode) and in a second antenna configuration in a second mode (e.g., high-band mode). The first antenna configuration can be when the folded monopole structure 520 is configured to operate as a low-band radiating element. The second antenna can be when the folded monopole structure 520 is configured to operate as a part of the second antenna element that operates in the high band. For example, the folded monopole structure 520 can radiate at a third harmonic in the high-band as a high-band radiating element. That is, the same antenna structure can be configured to radiate in the low-band while in the first antenna configuration and to radiate in the high-band while in the second antenna configuration.

FIG. 6 is a graph 600 of measured reflection coefficients 602, 604 of the two antenna elements of the dual-feed antenna 500 of FIG. 5 in high-band before changing the impedance of the folded monopole structure according to one embodiment. The graph 600 shows the measured reflection coefficient 602 (also referred to S-parameter) of the folded monopole structure 520. The graph 600 shows a fundamental harmonic frequency 606 of the low-band radiating element (e.g., folded monopole structure 520 in the first configuration) and a third harmonic 608 of the low-band radiating element (e.g., folded monopole structure 520 in the second configuration, i.e., when grounded). The graph 600 also shows the measured reflection coefficient 604 of the monopole structure 525 in an original high-band (HB) 610 before changing the impedance of the folded monopole structure 520 (i.e., before grounding). The graph 600 also illustrates isolation 612 between the two antenna elements before changing the impedance of the folded monopole structure 520. In the depicted embodiment, the isolation 612 is between about 2.1 GHz and about 2.99 GHz.

Figure 7:
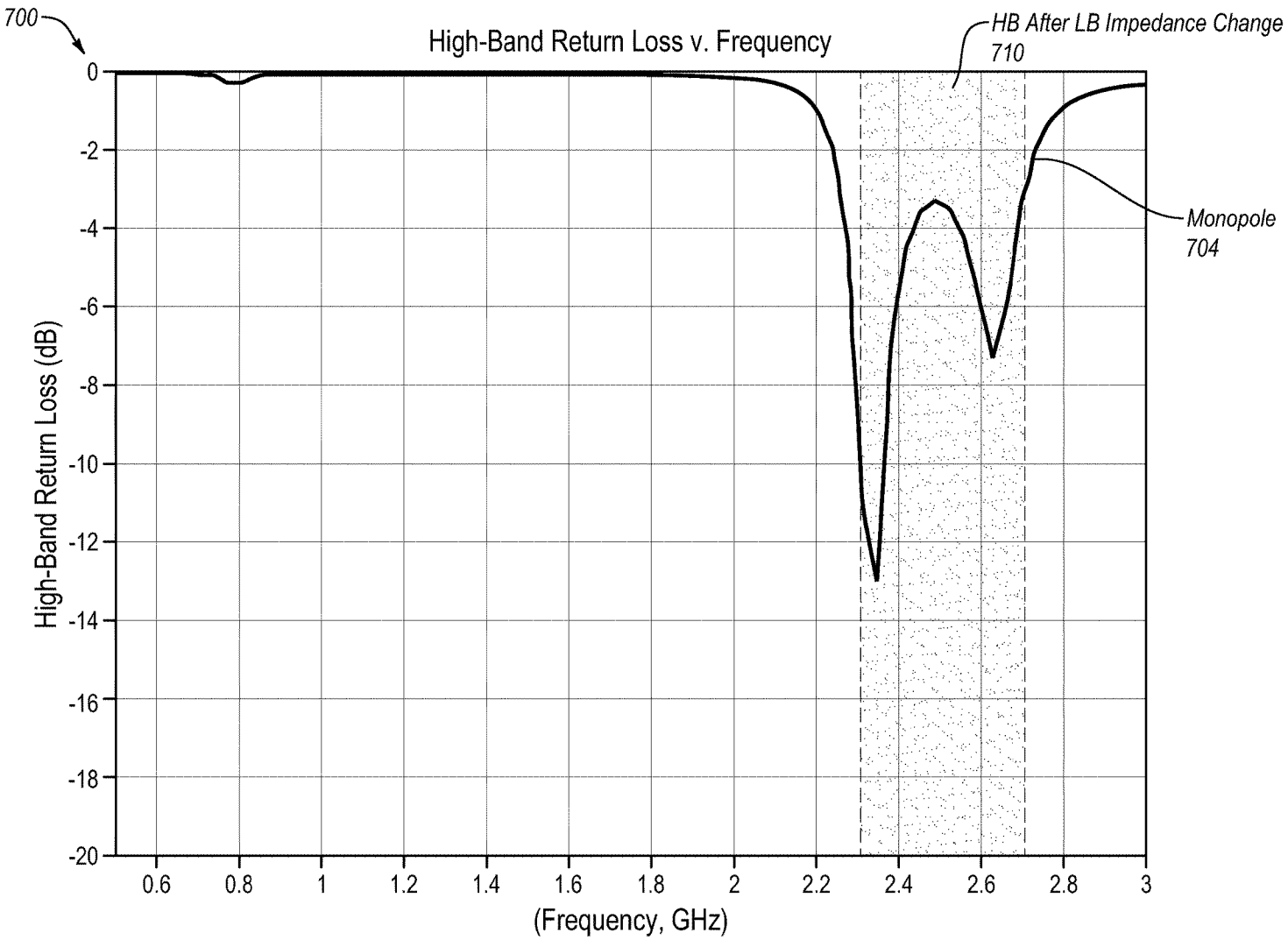
FIG. 7 is a graph of a measured reflection coefficient of the monopole structure of the dual-feed antenna of FIG. 5 in high band after changing the impedance of the folded monopole structure according to one embodiment.

FIG. 7 is a graph 700 of a measured reflection coefficient 704 of the monopole structure 525 of the dual-feed antenna 500 of FIG. 5 in high band after changing the impedance of the folded monopole structure 520 according to one embodiment. The graph 700 shows the measured reflection coefficient 704 of the monopole structure 525 in the same high band (HB) 710, but after changing the impedance of the folded monopole structure 520 (i.e., while grounded).

The dual-feed antenna 500 provides a resonant mode of those respective frequencies in the different modes of operation when the controllable circuit 550 configures the dual-feed antenna 500 into the different configurations. That is, the dual-feed antenna 500 decreases the reflection coefficient at the corresponding frequencies to create or form a low band (LB) and a high band (HB). In one embodiment, the dual-feed antenna 500 covers about 700 MHz to about 960 MHz in the LB and about 2.1 GHz to about 2.99 GHz in the HB. The folded monopole structure 520 in the second configuration may contribute to the HB between about 2.1 GHz to about 2.3 GHz due to the third harmonic 608. As described herein, other resonant modes may be achieved. Also, other frequency ranges may be covered by different designs of the dual-feed antenna as would be appreciated by one of ordinary skill in the art having the benefit of this disclosure.

Figure 8:
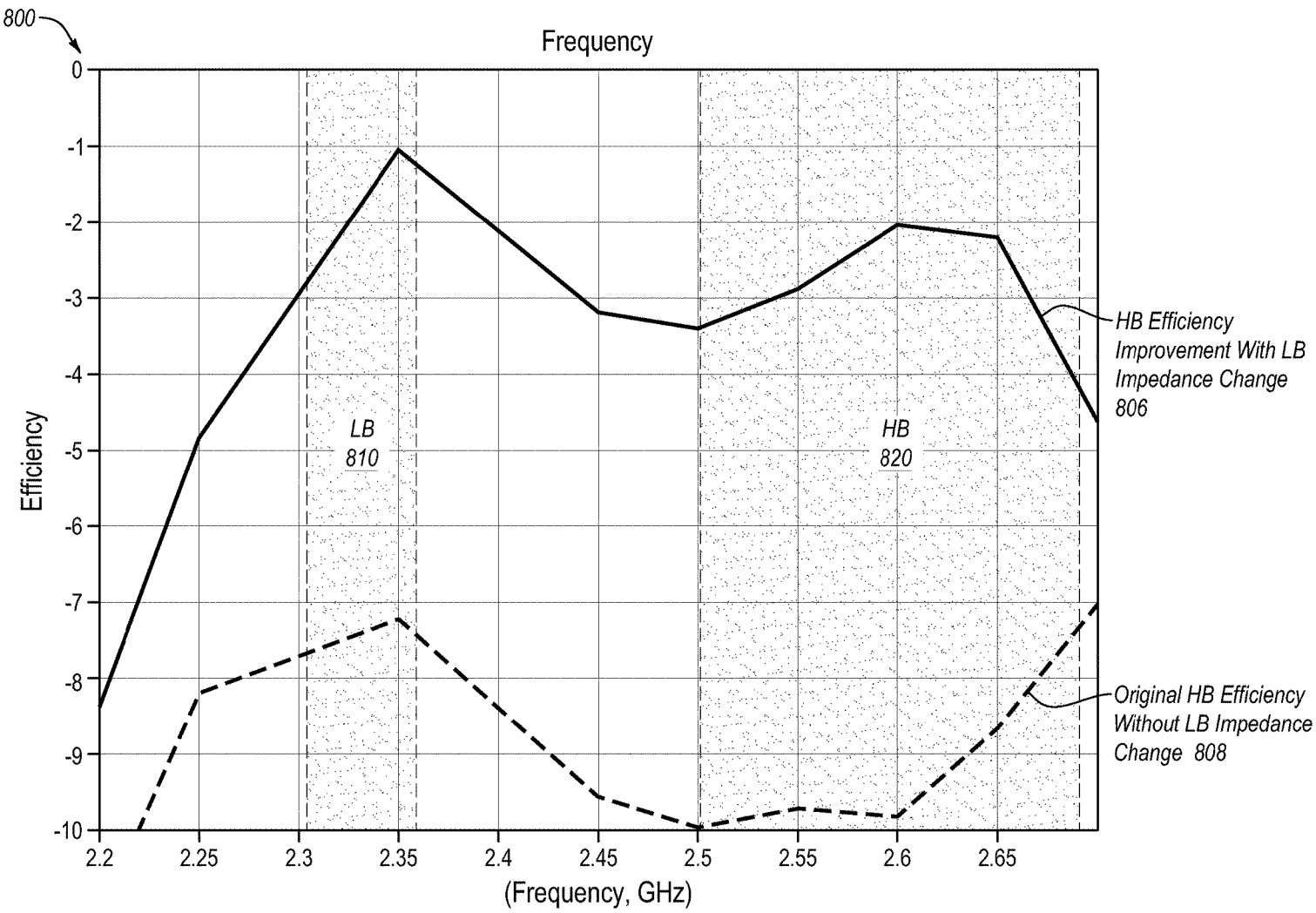
FIG. 8 is a graph of measured efficiencies of the dual-feed antenna of FIG. 5 before and after changing the impedance of the folded monopole structure according to one embodiment.

FIG. 8 is a graph of measured efficiencies 806, 808 of the dual-feed antenna 500 of FIG. 5 before and after changing the impedance of the folded monopole structure 520 according to one embodiment. The graph 800 illustrates the total efficiency 806 (original HB efficiency without LB impedance change) of the monopole structure 525 over a frequency range of a high-band (HB) of about 2.2 GHz to about 2.7 GHz before changing the impedance of the folded monopole structure 520 (i.e., first configuration) and after changing the impedance of the folded monopole structure 520 (i.e., second configuration). The graph 800 also illustrates the total efficiency 808 (improved HB efficiency with LB impedance change) of the monopole structure 525 over the frequency range in HB after changing the impedance of the folded monopole structure 520 (i.e., second configuration). As described herein, the third harmonic of the folded monopole structure 520 in the second configuration can increase the antenna's efficiency in the HB. In particular, the third harmonic contributes to the antenna's efficiency in the frequency range of about 2.1 GHz to about 2.3 GHz (HB2 820). The graph 800 illustrates that the dual-feed antenna 500 is a viable antenna for the respective frequency range in the HB and that the antenna efficiency can be improved by grounding the folded monopole structure 520. The efficiency of the antenna 500 can be tuned for specified target bands. The efficiency of the dual-feed antenna 500 may be modified by adjusting dimensions of the 3D structure, the gaps between the elements of the antenna structure, or any combination thereof. Similarly, 2D structures can be modified in dimensions and gaps between elements to improve the efficiency in certain frequency bands as would be appreciated by one of ordinary skill in the art having the benefit of this disclosure.

Figure 9:
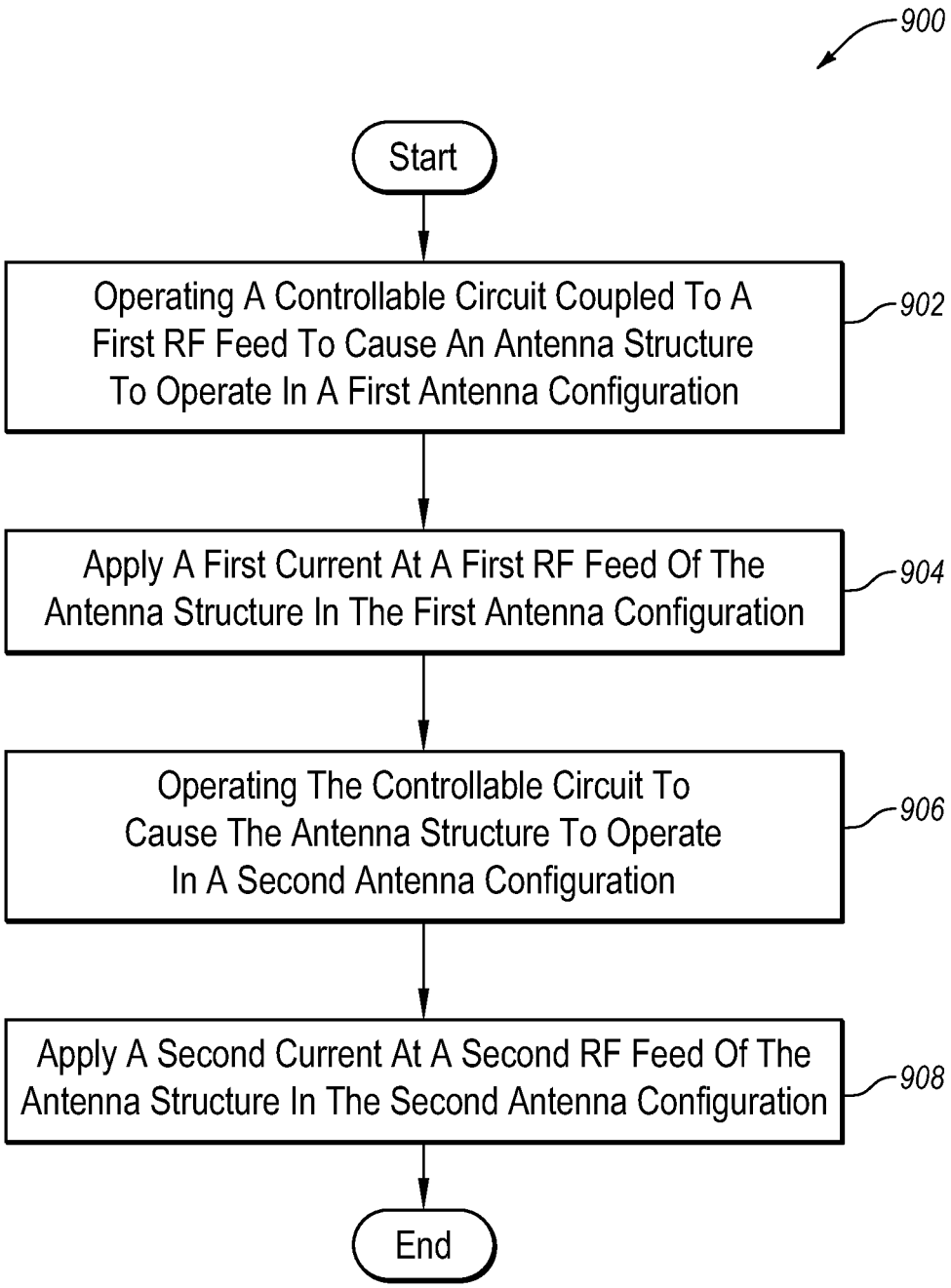
FIG. 9 is a flow diagram of an embodiment of a method of operating a user device having a dual-feed antenna according to one embodiment.

FIG. 9 is a flow diagram of an embodiment of a method 900 of operating an electronic device having a dual-feed antenna according to one embodiment. In method 900, a controllable circuit is operated to cause an antenna structure (e.g., dual-feed antenna 100 or 500) to operate in a first antenna configuration (block 902). The antenna structure includes a first antenna element coupled to a first radio frequency (RF) feed, the controllable circuit, and a second antenna element coupled to a second RF feed. In the first antenna configuration, the first antenna element is electrically connected to first RF feed via the controllable circuit. A first current is applied to the first antenna element via the first RF feed in the first configuration (block 904). In response to applying the first current, electromagnetic energy is radiated from the first antenna element in the first configuration.

The controllable circuit is operated to cause the antenna structure to operate in a second antenna configuration (block 906). In the second configuration, the first antenna element is electrically connected to ground via the controllable circuit. A second current is applied to the second antenna element at the second RF feed (block 908). In response to the second current, electromagnetic energy is radiated from the second antenna element and the first antenna element in the second configuration to communicate information to another device.

In another embodiment, the controllable circuit is operated to switch the first antenna element to be coupled a first matching network coupled to the first RF feed in the first configuration and the controllable circuit is operated to switch the first antenna element to be coupled to a second matching network coupled to the ground in the second antenna configuration.

In one embodiment, the antenna structure further includes a parasitic ground element that is parasitically induced by the second current. In particular, a third current is parasitically inducted at the parasitic ground element in the second configuration. In another embodiment, the first antenna element operates as a parasitic element as well in the second configuration. In response to applying the second current at the second RF feed, the second antenna element parasitically induces the third current on the parasitic ground element and a fourth current on the first antenna element in the second configuration. In response to the applied current and the parasitically induced current(s), when applicable, the antenna structure radiates electromagnetic energy to communicate information to another device. Regardless of the antenna configuration, the electromagnetic energy forms a radiation pattern. The radiation pattern may be various shapes as would be appreciated by one of ordinary skill in the art having the benefit of this disclosure.

In one embodiment, a current is applied at the RF feed, which induces a surface current flow of the respective antenna element. The second antenna element parasitically induces a current flow of the parasitic ground element(s). By inducing current flow at the parasitic ground element(s), bandwidth of the dual-feed antenna may be increased. The antenna structure of the dual-feed antenna can provide different resonant modes for a high-band. For example, the antenna structure in the first antenna configuration provides low-band resonant modes, and the antenna structure in the second antenna configuration provides high-band resonant modes. The first antenna element can be grounded to contribute to the high-band resonant modes as described herein. In one embodiment, the electromagnetic energy is radiated at a first frequency range of about 700 MHz to about 960 MHz in the first configuration and is radiated at a second frequency range about 1.71 GHz to about 2.69 GHz in the second configuration.

Figure 10:
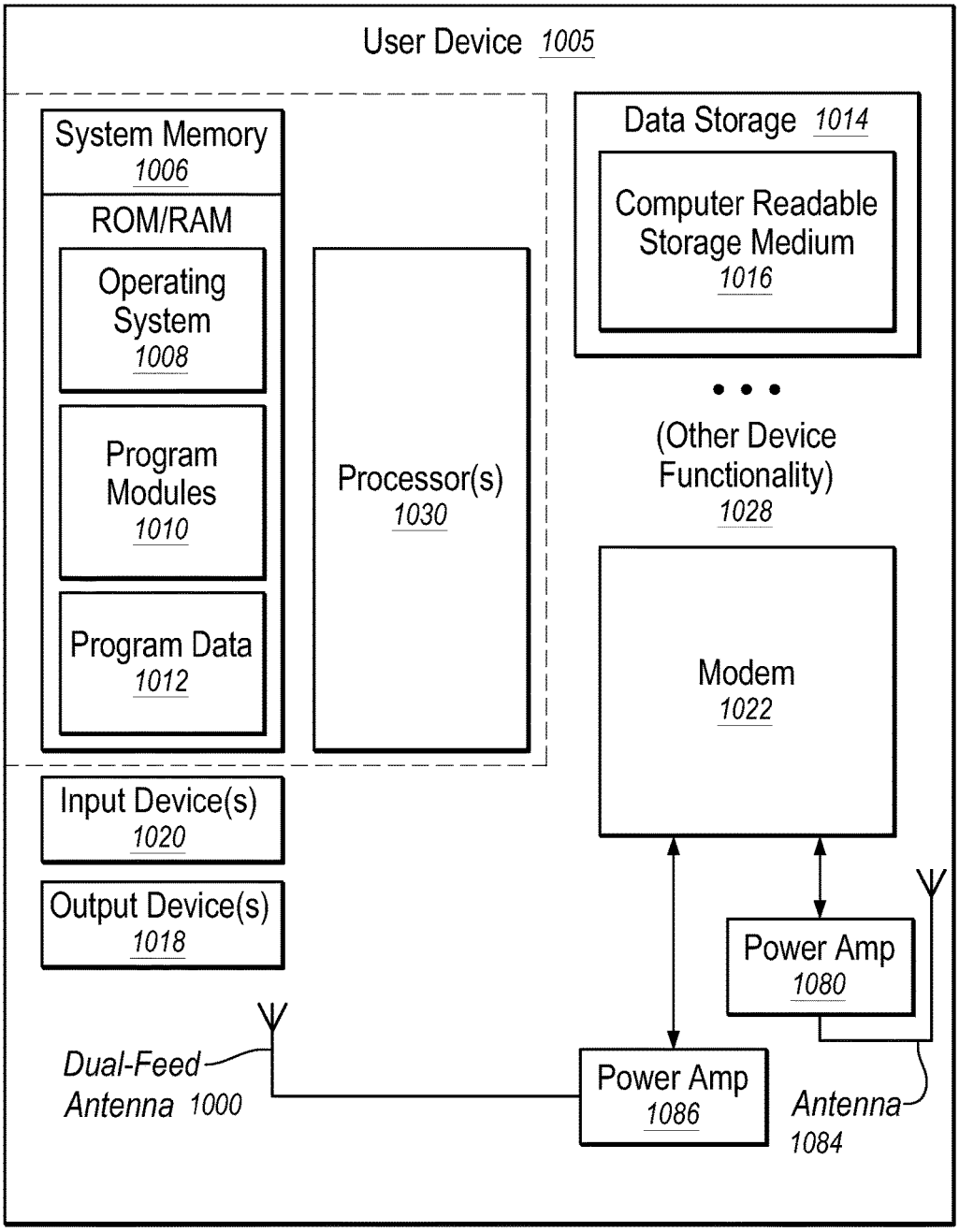
FIG. 10 is a block diagram of a user device having a dual-feed antenna according to one embodiment.

FIG. 10 is a block diagram of a user device 1005 having the dual-feed antenna 1000 according to one embodiment. The user device 1005 includes one or more processors 1030, such as one or more CPUs, microcontrollers, field programmable gate arrays, or other types of processing devices. The user device 1005 also includes system memory 1006, which may correspond to any combination of volatile and/or non-volatile storage mechanisms. The system memory 1006 stores information, which provides an operating system component 1008, various program modules 1010, program data 1012, and/or other components. The user device 1005 performs functions by using the processor(s) 1030 to execute instructions provided by the system memory 1006.

The user device 1005 also includes a data storage device 1014 that may be composed of one or more types of removable storage and/or one or more types of non-removable storage. The data storage device 1014 includes a computer-readable storage medium 1016 on which is stored one or more sets of instructions embodying any one or more of the functions of the user device 1005, as described herein. As shown, instructions may reside, completely or at least partially, within the computer readable storage medium 1016, system memory 1006 and/or within the processor(s) 1030 during execution thereof by the user device 1005, the system memory 1006 and the processor(s) 1030 also constituting computer-readable media. The user device 1005 may also include one or more input devices 1020 (keyboard, mouse device, specialized selection keys, etc.) and one or more output devices 1018 (displays, printers, audio output mechanisms, etc.).

The user device 1005 further includes a wireless modem 1022 to allow the user device 1005 to communicate via a wireless network (e.g., such as provided by a wireless communication system) with other computing devices, such as remote computers, an item providing system, and so forth. The wireless modem 1022 allows the user device 1005 to handle both voice and non-voice communications (such as communications for text messages, multimedia messages, media downloads, web browsing, etc.) with a wireless communication system. The wireless modem 1022 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WLAN (e.g., Wi-Fi® network), etc. In other embodiments, the wireless modem 1022 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 1005 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1005 to communicate with other devices, such as other user devices, server computing systems, telephone devices, or the like. In addition to wirelessly connecting to a wireless communication system, the user device 1005 may also wirelessly connect with other user devices. For example, user device 1005 may form a wireless ad hoc (peer-to-peer) network with another user device.

The wireless modem 1022 may generate signals and send these signals to power amplifier (amp) 1080 or power amp 1086 for amplification, after which they are wirelessly transmitted via the dual-feed antenna 1000 or antenna 1084, respectively. Although FIG. 10 illustrates power amps 1080 and 1086, in other embodiments, a transceiver may be used for all the antennas 1000 and 1084 to transmit and receive. The antenna 1084, which is an optional antenna that is separate from the dual-feed antenna 1000, may be any directional, omnidirectional or non-directional antenna in a different frequency band than the frequency bands of the dual-feed antenna 1000. The antenna 1084 may also transmit information using different wireless communication protocols than the dual-feed antenna 100. In addition to sending data, the dual-feed antenna 1000 and the antenna 1084 also receive data, which is sent to wireless modem 1022 and transferred to processor(s) 1030. It should be noted that, in other embodiments, the user device 1005 may include more or less components as illustrated in the block diagram of FIG. 10. In one embodiment, the dual-feed antenna 1000 is the dual-feed antenna 100 of FIG. 1. In another embodiment, the dual-feed antenna 1000 is the dual-feed antenna 500 of FIG. 5. Alternatively, the dual-feed antenna 1000 may be other dual-feed antennas as described herein.

In one embodiment, the user device 1005 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of the dual-feed antenna 100 that operates at a first frequency band and the second wireless connection is associated with a second resonant mode of the dual-feed antenna 100 that operates at a second frequency band. In another embodiment, the first wireless connection is associated with the dual-feed antenna 100 and the second wireless connection is associated with the antenna 1084. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1022 is shown to control transmission to both antennas 100 and 1084, the user device 1005 may alternatively include multiple wireless modems, each of which is configured to transmit/receive data via a different antenna and/or wireless transmission protocol. In addition, the user device 1005, while illustrated with two antennas 100 and 1084, may include more or fewer antennas in various embodiments.

The user device 1005 delivers and/or receives items, upgrades, and/or other information via the network. For example, the user device 1005 may download or receive items from an item providing system. The item providing system receives various requests, instructions and other data from the user device 1005 via the network. The item providing system may include one or more machines (e.g., one or more server computer systems, routers, gateways, etc.) that have processing and storage capabilities to provide the above functionality. Communication between the item providing system and the user device 1005 may be enabled via any communication infrastructure. One example of such an infrastructure includes a combination of a wide area network (WAN) and wireless infrastructure, which allows a user to use the user device 1005 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 1005.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1005 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1005 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device, comprising:

a first tunable radio frequency (RF) feed;

a folded monopole structure coupled to the first tunable RF feed at a first end and to a ground plane at a second end of the folded monopole structure;

a second RF feed; and a coupled monopole structure, a first end of which is coupled to the second RF feed and a second end of which is coupled to the ground plane, wherein the folded monopole structure and the coupled monopole structure are located within a plane parallel to the ground plane, and wherein the first tunable RF feed is to:

in a first mode, feed the folded monopole structure to operate as a radiating element in a low band; and in a second mode, electrically short the first end of the folded monopole structure to the ground plane such that the folded monopole structure acts as a parasitic element in a high band, the parasitic element being parasitically coupled to the coupled monopole structure while the coupled monopole structure is fed in the high band.

2. The electronic device of claim 1, further comprising a parasitic ground element coupled to the ground plane and parasitically coupled to the coupled monopole structure, wherein the parasitic ground element is not conductively connected to the second RF feed.

3. The electronic device of claim 1, wherein the folded monopole structure is to radiate electromagnetic energy as a folded monopole antenna in the first mode and to radiate electromagnetic energy as a parasitic ground element in the second mode when the first tunable RF feed electrically shorts the folded monopole structure to the ground plane.

4. The electronic device of claim 3, wherein the folded monopole antenna is to operate in a first frequency range of about 700 MHz to about 960 MHz in the first mode and the parasitic ground element is to operate in a second frequency range of about 1.71 GHz to about 2.69 GHz in the second mode.

5. The electronic device of claim 1, further comprising a controllable circuit coupled to the first tunable RF feed, wherein the controllable circuit comprises:

a switch;

a first matching network coupled to the first RF feed; and a second matching network coupled to the ground plane, wherein the switch is to couple the folded monopole structure to the first matching network in a first antenna configuration and to couple the folded monopole structure to the second matching network in a second antenna configuration.

6. An apparatus comprising:

a first radio frequency (RF) feed;

a controllable circuit coupled to the first RF feed;

a second RF feed; and an antenna structure comprising:

a first antenna element coupled to the controllable circuit; and a second antenna element coupled to the second RF feed, wherein the second antenna element includes a coupled monopole structure coupled between the second RF feed and a ground, and wherein the controllable circuit is to electrically connect the first antenna element to the first RF feed in a first antenna configuration to operate as a low-band radiating element and to electrically connect the first antenna element to the ground in a second antenna configuration to operate as a high-band radiating element.

7. The apparatus of claim 6, wherein the first antenna element is a folded monopole structure in the first antenna configuration and a parasitic ground element in the second antenna configuration.

8. The apparatus of claim 6, wherein the first antenna element is a loop antenna structure in the first antenna configuration and a parasitic ground element in the second antenna configuration.

9. The apparatus of claim 6, wherein the first antenna element is a patch antenna structure in the first antenna configuration and a parasitic ground element in the second antenna configuration.

10. The apparatus of claim 9, wherein the patch antenna structure is a planar inverted-F antenna (PIFA) structure.

11. The apparatus of claim 6, wherein the controllable circuit comprises:

a switch;

a first matching network coupled to the first RF feed; and a second matching network coupled to the ground, wherein the switch is to couple the first antenna element to the first matching network in the first antenna configuration and to couple the first antenna element to the second matching network in the second antenna configuration.

12. The apparatus of claim 6, wherein the antenna structure is to operate in a first frequency range in the first antenna configuration and the antenna structure is to operate in a second frequency range in the second antenna configuration, wherein the first frequency range is about 700 MHz to about 960 MHz and the second frequency range is about 1.71 GHz to about 2.69 GHz.

13. The apparatus of claim 6, wherein the first antenna element is to operate in a first frequency range of about 700 MHz to about 960 MHz in the first antenna configuration and the first antenna element is to operate in a second frequency range of about 2.1 GHz to about 2.69 GHz in the second antenna configuration.

14. The apparatus of claim 6, wherein the first antenna element comprises a folded monopole structure, wherein the folded monopole structure further comprises:

a first portion that extends from the first RF feed in a first direction until a first fold;

a second portion that extends from the first fold in a second direction until a second fold;

a third portion that extends from the second fold in a third direction until a third fold;

a fourth portion that extends from the third fold in a fourth direction until a fourth fold and is laid out at least partially in parallel to the second portion; and a fifth portion that extends from the fourth fold in a fifth direction until the ground and is laid out at least partially in parallel to the first portion, and wherein the controllable circuit is disposed at a proximal end of the first portion, the proximal end being the nearest from the first RF feed.

15. The apparatus of claim 14, wherein a section of a distal end of the folded monopole structure is folded in the third direction towards the ground.

16. The apparatus of claim 14, further comprising a parasitic ground element coupled to the ground, wherein the parasitic ground element is not conductively connected to the second RF feed.

17. The apparatus of claim 16, wherein the second antenna element comprises:

a sixth portion that extends from the second RF feed in the first direction until a fifth fold and is laid out at least partially in parallel to the first portion;

a seventh portion that extends from the fifth fold in the fourth direction until a sixth fold; and an eighth portion that extends from the sixth fold in the third direction, wherein a gap is between a distal end of the eighth portion and the ground, the distal end being the farthest from the second RF feed.

18. The apparatus of claim 17, wherein the parasitic ground element comprises:

a ninth portion that extends from the ground in the first direction until a seventh fold;

a tenth portion that extends from the seventh fold in the fourth direction until an eighth fold;

an eleventh portion that extends from the eighth fold in the first direction until a ninth fold; and a block portion coupled to a distal end of the ninth portion, the distal end being the farthest away from the ground, wherein the block portion extends in at least one of the second direction or fourth direction and is laid out at least partially in parallel to the seventh portion.

19. The apparatus of claim 6, further comprising an antenna carrier upon which the antenna structure is disposed, wherein the first antenna element is disposed in a first plane, and wherein the coupled monopole structure of the second antenna element is disposed at least partially in the first plane and at least partially in a second plane.

20. A method of operating an electronic device comprising:

operating a controllable circuit coupled to a first radio frequency (RF) feed to cause an antenna structure to operate in a first antenna configuration, wherein the antenna structure comprises:

a first antenna element coupled to the controllable circuit; and a second antenna element coupled to a second RF feed, wherein the second antenna element includes a coupled monopole structure coupled between the second RF feed and a ground, and wherein the first antenna element is electrically connected to the first RF feed via the controllable circuit in the first antenna configuration;

applying a first current at the first RF feed when the antenna structure is to operate in the first antenna configuration, wherein the first antenna element operates as a low-band radiating element in the first antenna configuration;

operating the controllable circuit to cause the antenna structure to operate in a second antenna configuration, wherein the first antenna element operates as a high-band radiating element in the second configuration, and wherein the first antenna element is electrically connected to ground via the controllable circuit in the second antenna configuration; and applying a second current at the second RF feed when the antenna structure is to operate in the second antenna configuration.

21. The method of claim 20, wherein the operating the controllable circuit in the first antenna configuration comprises switching the first antenna element to be coupled to a first matching network coupled to the first RF feed in the first configuration, and wherein the operating the controllable circuit in the second antenna configuration comprises switching the first antenna element to be coupled to a second matching network coupled to the ground in the second antenna configuration.

22. The method of claim 20, wherein the second antenna element comprises a parasitic ground element coupled to a ground plane, wherein the parasitic ground element is not conductively connected to the second RF feed, wherein application of the second current parasitically induces a third current on the parasitic ground element in the second configuration and parasitically induces a fourth current on the first antenna element in the second configuration.

23. The method of claim 22, wherein:

the first current is to cause the first antenna element to radiate at a first frequency range of about 700 MHz to about 960 MHz in the first configuration; and the second current is to cause the second antenna element to radiate at a second frequency range of about 1.71 GHz to about 2.69 GHz in the second configuration.

* * * * *